US006474961B1

(12) United States Patent
Timmer et al.

(10) Patent No.: US 6,474,961 B1
(45) Date of Patent: Nov. 5, 2002

(54) COMPACT DUAL DIAPHRAGM PUMP

(76) Inventors: Oliver Timmer, Alsenstrasse 4, 48147 Muenster (DE); Herbert Timmer, Wersewinkel 24, 48155 Muenster (DE); Josef Schmeing, Darlagenstrasse 25, 48485 Neuenkirchen (DE)

( * ) Notice: Subject to any disclaimer, the term of this patent is extended or adjusted under 35 U.S.C. 154(b) by 9 days.

(21) Appl. No.: 09/677,320

(22) Filed: Sep. 29, 2000

(30) Foreign Application Priority Data

Sep. 29, 1999 (DE) ..... 199 46 562

(51) Int. Cl.[7] ..... F04B 17/00; F04B 43/06

(52) U.S. Cl. ..... 417/393; 417/395

(58) Field of Search ..... 417/375, 397, 417/393, 395, 404, 410.1, 413.1, 389, 390

(56) References Cited

U.S. PATENT DOCUMENTS 4,172,698 A * 10/1979 Hinz et al. ..... 417/393
4,496,294 A * 1/1985 Frikker ..... 417/393
5,232,352 A * 8/1993 Robinson ..... 417/393

* cited by examiner

*Primary Examiner*—Joseph Pelham
*Assistant Examiner*—Thor Campbell
(74) *Attorney, Agent, or Firm*—Milde & Hoffberg, LLP

(57) ABSTRACT

A dual diaphragm pump includes a central housing having a pair of opposed housing surfaces, each surface having a housing diaphragm recess and a pair of housing valve recesses, and a pair of covers, each cover having a surface with a cover diaphragm recess and a pair of cover valve recesses. The covers are mated to the housing so that the diaphragm recesses form a pair of pumping chambers with diaphragms therein, and the valve recesses form valve chambers with check valves therein.

11 Claims, 3 Drawing Sheets

COMPACT DUAL DIAPHRAGM PUMP

BACKGROUND OF THE INVENTION

The invention relates to a diaphragm pump.

A diaphragm pump is known from DE 39 40 629 A1. It consists of a housing body that can be closed on both sides with a cover. Two facing diaphragm recesses each provided with one diaphragm are integrated in the housing body. Both diaphragm recesses are connected by a valve unit. Diaphragm recesses are also provided for the covers, such that pump chambers allowing the movements of the diaphragms are created when the covers are placed on the housing body. Furthermore, four check valves are present that have the same functional direction as the diaphragms. The check valves are housed in valve chambers that are located in both the housing body and the covers.

Although due to the same functional direction of the diaphragm and check valve, the diaphragms are easily accessible when the covers are removed; a disadvantage is that the check valves drop out of the valve chambers. Because the check valves consists of balls with a spring tension, the balls are propelled in normal fashion out of the valve chambers. Thus, maintenance can be carried out only with additional auxiliary means. The same is true for the assembly. Furthermore, a dual diaphragm pump is known from AS 27 26 674 or from U.S. Pat. No. 3,652,187, which is incorporated herein by reference. A dual diaphragm pump has a housing that incorporates two diaphragms and a control valve. The diaphragms divide the chambers of the diaphragm pump into drive chambers and pump chambers. Flow valves are assigned to the pump chambers. On each side, the housing is closed with a housing cover. The control valve is automatically moved at the end of each reciprocating stroke between two alternating positions to reverse fluid flow to the pump and thereby causes the pump to reciprocate.

The disadvantage is that the dual diaphragm pumps are not controlled with sufficient accuracy by the control valve. Furthermore, the suction and discharge valves are insufficiently seated in the housing such that the dual diaphragm pump is difficult to maintain and repair.

From the IT catalog of the company DEBEM: BOXER pompe a membrana azionate ad aria compressa [diaphragm pump actuated by compressed air], May 1988, pages 1 to 12 is known. This dual diaphragm pump includes two dual diaphragms. Each dual diaphragm is surrounded by an extra housing that is connected by piping and arranged on a base frame. One check valve is installed above each valve housing. A cubic housing can be used in place of the base frame.

The disadvantage is that essentially the entire dual diaphragm pump needs to be taken apart to inspect or repair the dual diaphragm pump. An additional disadvantage is that the pump requires a substantial amount of space.

SUMMARY OF THE INVENTION

The object of the invention is to provide a diaphragm pump wherein assembly and maintenance of the pump are easier and simpler.

According to the invention, a dual diaphragm pump includes a central housing having a pair of opposed housing surfaces, and a pair of covers each having a cover surface mated to a respective housing surface. Each surface has a diaphragm recess and a pair of valve recesses, the assembly having two pumping chambers with diaphragms therein and four valve chambers with check valves therein.

The advantages achieved with the invention consist basically in that through the two removable covers, the diaphragm body elements as well as the check valves become easily accessible for maintenance purposes. For inspections or repairs, the check valves simply need to be removed from the valve recesses of the housing and thereafter either cleaned or replaced by new ones or can easily be inserted during assembly. Cumbersome handling with springs and the like is not required. The two valve chambers are formed and the check valves fully taken in upon closing the center part of the housing with the two housing covers. It should be emphasized that by arranging the check valves on one side next to the housing chamber recesses, the pump can be built in a small and compact manner.

Two dual-path valves can be located in the center part of the housing. This increases the control accuracy.

One or more center parts of the housing or one or more diaphragm body elements can be used, creating a multiple diaphragm pump. Typically, two facing diaphragm body elements are used for a dual diaphragm pump. The diaphragm body elements can be designed as dual diaphragm body elements.

The housing can be designed as a compact housing. Externally, the compact housing looks like a monolithic block. This ensures that the housing can safely withstand both static and dynamic loads. The compact housing can be designed in a cubic shape. The cubic shape allows for several compact housings to be placed next to one another such that several dual diaphragm pumps can function in tandem in the smallest possible space.

At least partially, channels for flow can be positioned on the inside of the central housing body, in the elemental surface areas of the housing and in the interior elemental surface areas of the covers. These channels for the flow form complete and continuous flow paths when the housing cover is placed on the central housing unit. This saves the very elaborate installation of individual lines between the parts of the dual diaphragm pump.

Each check valve consists of a one-side open valve seat for the check valve. The valve seat for the check valve is built like a running wheel cage for hamsters and consists of two rings at opposite ends that are connected by interim rods. One ring exhibits an opening such that a valve ball can be inserted through it. The other ring has an opening such that the ball can be supported. During assembly, the check valve seats in the shape of hamster cages are simply plugged into the housing valve recesses. Before that, the valve ball is inserted. When the respective covers are placed on the pump body, the full valve chamber, which then surrounds the check valve, is formed. For inspection or repair of the check valve, it is only required to take out the check valve seat with the valve ball and to clean it or replace it with another. This reduces the effort for assembly, inspection and repair to a minimum. The same applies to the dual diaphragms.

The first and second housing cover can each be attached to the central housing unit using at least one screw element. This enables a removal of the housing cover for inspection and repair purposes.

The central housing unit and the housing cover may consist, at least in part, of synthetics and/or metal. It allows for the option to produce the entire housing of synthetics or of metal. However, it is also possible to make the central part of synthetics and the two covers of metal, or the central part of metal and the two covers of synthetics, or the central part and one cover of metal and the second cover of synthetics. The materials and material combinations to be used depend on the respective conditions during use.

For flow volumes of 25 to 30 liters per minute, the compact housing may have a length of between 130 and 170 mm, a height of between 70 and 95 mm and a width of between 70 and 95 mm. Preferably, the compact housing is 143 mm long and 81×81 mm high×wide.

BRIEF DESCRIPTION OF THE DRAWINGS

FIG. 5 is a perspective view of the component housing of the dual diaphragm pump of FIGS. 1–4.;

DETAILED DESCRIPTION OF THE PREFERRED EMBODIMENT

Dual diaphragm pumps can be used anywhere, where the objective is to pump fluids cost-effectively.

Such a dual diaphragm pump is presented in FIGS. 1 to 5.

The dual diaphragm pump includes a central housing unit 7 that on both sides is defined by housing surfaces 61, 62.

Figure 2:
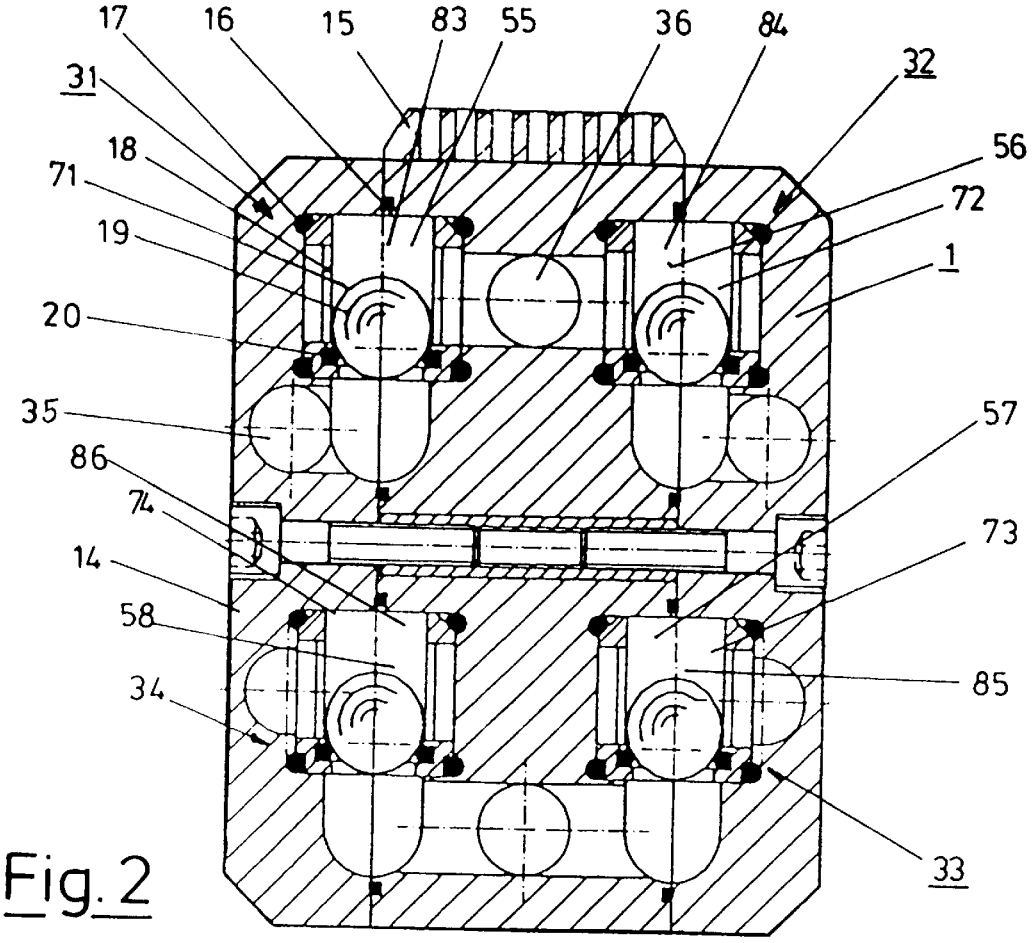
FIG. 2 shows a schematic cross-section of a dual diaphragm pump taken along the line 2—2 of FIG. 1.

One housing diaphragm recess 51, 52 is included in each of the two housing surfaces 61, 62. As especially FIG. 2 shows, housing valve recesses 55, 56, 57, 58 are arranged above one another next to each housing diaphragm recess 51, 52.

A dual diaphragm body element 5 is placed into the housing diaphragm recess 51 and a dual diaphragm body element 30 in the opposite housing diaphragm recess 52.

The two dual diaphragm body elements 5, 30 with their diaphragm rods 38, 39 are located opposite to one another. A rod gasket 2, a support disk 3 and a serrated disk 4 are arranged in the area of the diaphragm rods. This ensures that the two diaphragm body elements move particularly low in noise and vibrations.

The two housing diaphragm recesses 51, 52 are also known as drive chambers. They are both connected by two two-way valves 37. The two two-way valves 37 are located at a main valve 307. Both the two two-way valves 37 and the main valve 307 are located in the central housing unit 7.

Figure 3:
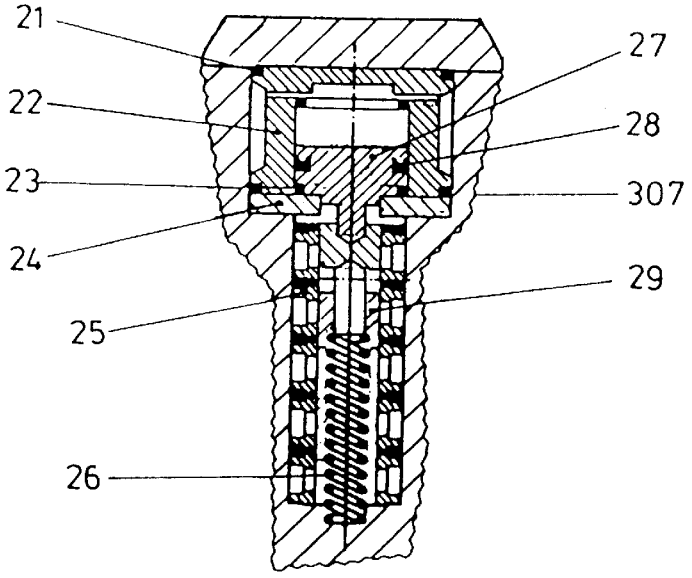
FIG. 3 shows a magnified presentation of a main valve of a dual diaphragm pump according to FIG. 1.

FIG. 3 shows the main valve 307 in detail. It includes an O-ring 21 that terminates the main valve bushing 22. An O-ring 23 is located in the main valve bushing 22 next to the O-ring 21. An interim valve cover 24 that contains a gasket set 25 is located underneath the O-ring 23. Located inside the gasket set 25 is a main valve spring 26. A main valve piston 27 with a valve piston gasket 28 assigned to it is located in the main valve bushing 22. The number 29 stands for a valve tappet.

Figure 1:
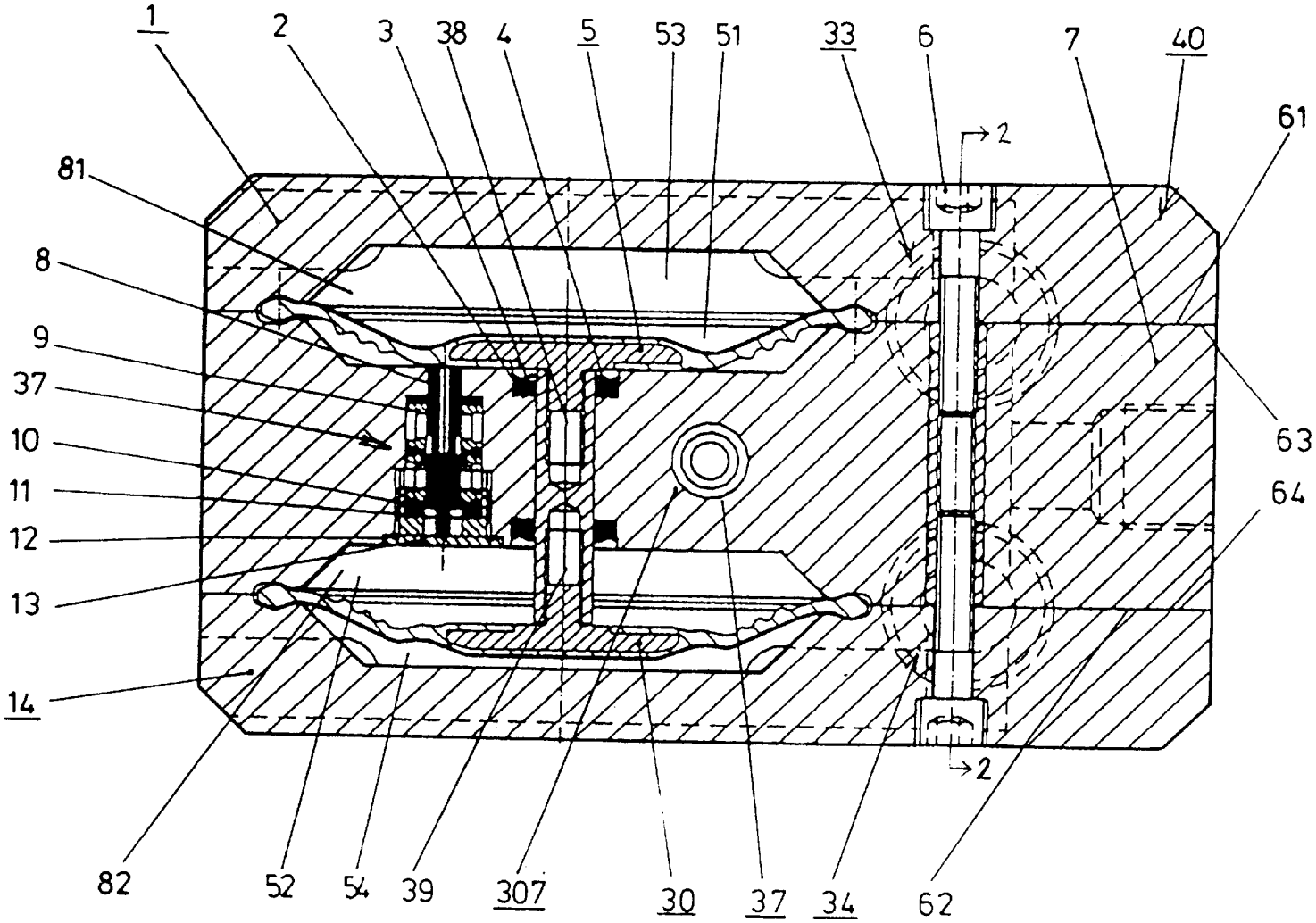
FIG. 1 schematically shows a longitudinal section of a dual diaphragm pump, according to the invention.

As FIG. 1 shows, the two-way valves 37 each include a finish switch stem 8, a gasket set 9, a finish switch 10, an interim valve cover 11, an O-ring element 12 and a finish switch cover 13. The two-way valves 37 are commercially available and exhibit a basically known design with a basically known function.

Figure 4:
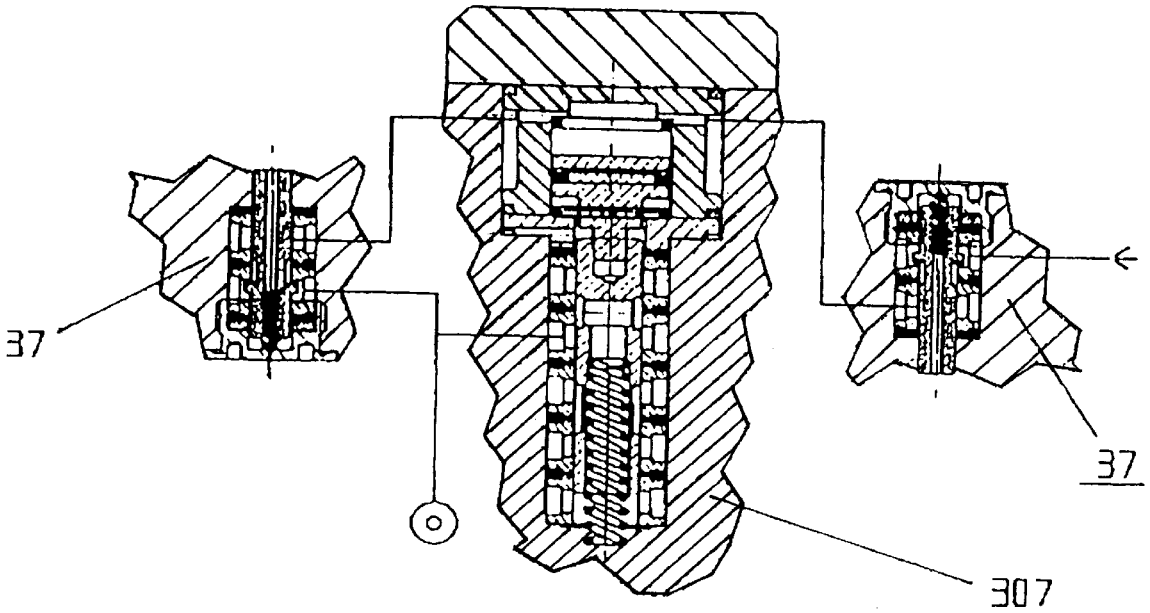
FIG. 4 is a schematic cross-section showing the flow connections between the two-way valves and the main valve.

The functions of all diaphragm valves are shown in cross-section in FIG. 4 and connected with each other. The actuation of a 2/2 way valve 37 through a diaphragm 5 is effected by an airstream in the 5/2 way valve 307. The main valve 307 is switched over to this airstream and effects therewith an airstream in the diaphragm chamber. One diaphragm makes a reciprocating stroke whereby a second diaphragm, which is coupled to the first diaphragm through a piston rod 38, likewise carries out a reciprocating stroke.

At the end of the reciprocating stroke, the second end switch 37 is actuated, which effects a release ("deairing") of the 5/2 path valve. The 5/2 path valve is then switched over by the force of spring and effects an airstream in the second diaphragm chamber, whereby the diaphragms again carry out a reciprocating stroke. The reciprocating stroke effects an actuation of the 5/2 way valve, which began with the previous actuation.

The four check valves 31, 32, 33, 34 each have a check valve seat 18. The check valve seat resembles a running wheel cage for a hamster or a mouse to move. The check valve consists of two opposite rings that are connected by round rods. One of the rings has an opening of a size such that a valve ball 19 can be inserted but it cannot pass through the opposite ring, where it seats against an O-ring 20.

These check valve seats are inserted into the valve housing recesses 55, 56, 57, 58 together with O-rings 17 and the valve balls 19.

The two housing covers 1, 14 each have a cover surface 63, 64 with a cover diaphragm recess 53 and 54. Furthermore, two cover valve recesses 71, 72, 73, 74 in addition to the cover diaphragm recess 53, 54 are integrated in each surface 63, 64.

When the housing cover surfaces 63, 64 are placed onto the housing surfaces 61, 62 and fastened using the screw elements 6, then the housing diaphragm recess 51 and cover diaphragm recess 53 form a pump chamber 81, and the housing diaphragm recess 52 and cover diaphragm recess 54 form a pump chamber 82. Furthermore, the four housing valve recesses 55, 56, 57, 58 together with the four cover valve recesses 71, 72, 73, 74 of the respective cover form four valve chambers 83, 84, 85, 86.

Flow channels 35, 36 (cf. especially FIG. 2) are integrated in both the housing covers 1, 14 and the central housing unit 7. This creates flow connections that ensure the function of the dual diaphragm pump in cooperation with the individual valves when the compact housing 40 is put together (cf. FIG. 5).

As especially FIG. 1 shows, an end switch cover 13 and a main valve cover element 15 (cf. FIG. 2) are integrated in the central housing unit 7.

It should be emphasized that the dual diaphragm pump subject to the invention is extremely small due to its intelligent design. With a flow volume between 25 and 30 liters per minute, it has a length of about 143 mm, a height of 81 mm and a width of 81 mm as well. In this manner, it is possible to arrange several dual diaphragm pumps next to one another in the smallest space, if necessary. It should be emphasized that replacing a diaphragm has become extremely simple. The two diaphragms as well as the valves are exposed immediately simply by loosening a few screws.

The dual diaphragm pump can be operated without oiled compressed air as well. This avoids an additional maintenance effort for collecting used oil. The dual diaphragm body elements 5, 30 dampen the pulsation. With the design, the pulsation damper has essentially been integrated in the pump. It should be emphasized that the dual diaphragm pump runs extremely quiet due to its special design.

Additional vibration-absorbing legs that are arranged at the compact housing 40 effectively absorb the vibrations.

What is claimed is:

1. Diaphragm pump that comprises:

at least one diaphragm body element (5, 30), that is each located in a pump chamber (81, 82) and a drive chamber (51, 52), whose guided diaphragm rods (38, 39) are partially opposite to one another and where a control valve (37, 307) and two check valves (31, 32, 33, 34) each are assigned to them acting as suction and discharge valves, and one housing element (40) with at least one central housing unit (7) and two housing covers (1, 14) that together with the diaphragm body elements (5, 30) surrounds the control valve (37, 307) and the check valves (31, 32, 33, 34), wherein the opposite housing surfaces (61, 62) of the central housing unit (7), two housing valve recesses (55, 56, 57, 58) each are integrated next to a housing diaphragm recess (51, 52) acting as a drive chamber, where check valves (31, 32, 33, 34) that are in the functional direction at a right angle to diaphragm body elements are to be inserted at least partially in the valve recesses, such that they are arranged in one sectional plane, wherein the control valve is comprised of at least one way valve (37) located in a central housing unit (7) that is used to connect the opposite housing diaphragm recesses (51, 52) and that is connected to a main valve (13) that is located in the central housing unit (7) as well, and wherein in each cover surface (63, 64) two cover valve recesses (71, 72, 73, 74) are integrated in addition to a cover diaphragm recess (53, 54) that co-form the pump chamber, where said cover valve recesses together with the housing valve recesses (55, 56, 57, 58) form four valve chambers, where one of the four check valves (31, 32, 33, 34) is located in each of them.

2. Diaphragm pump as set forth in claim 1, wherein two two-way valves (37) are located in the central housing unit (7) as way valves.

3. Diaphragm pump as set forth in claim 1, wherein two opposite dual diaphragm body elements (5, 30) as diaphragm body elements are located in a central housing unit (7).

4. Diaphragm pump as set forth in claim 1, wherein the housing element is designed as a compact housing (40).

5. Diaphragm pump as set forth in claim 1, wherein the compact housing (40) has a cubic shape.

6. Diaphragm pump as set forth in claim 1, wherein flow channels (35, 36) are located at least partially in the inside of the central housing unit (7), in the housing area elements (61, 62) and the cover area elements (63, 64).

7. Diaphragm pump as set forth in claim 1, wherein each check valve (31, 32, 33, 34) consists of an on one side open and cage-shaped valve seat (8) for the check valve, where in the valve seat a valve ball (19) is to be placed that is to be inserted in the housing valve recess (55, 56, 57, 58) and surrounded by the valve chamber (83, 84, 85, 86).

8. Diaphragm pump as set forth in claim 1, wherein the first and the second housing cover (1, 14) can be connected to the central housing unit (7) using at least one screw element (6) each.

9. Diaphragm pump as set forth in claim 1, wherein the central housing unit (7) and the housing covers consist at least partially of synthetics and/or metal.

10. Diaphragm pump as set forth in claim 1, wherein for a flow of 25 to 30 liters per minute, the compact housing (40) is between 130 and 170 mm long, between 70 and 95 mm high and between 70 and 95 mm wide.

11. A dual diaphragm pump comprising:

a central housing having a pair of opposed housing surfaces, each surface having therein a housing diaphragm recess and a pair of housing valve recesses, a pair of housing covers, each cover having a cover surface with a cover diaphragm recess and a pair of cover valve recesses, each cover surface being fixed against a respective housing surface so that said diaphragm recesses form a pair of pumping chambers and said valve recesses form four valve chambers, a pair of diaphragm bodies located in respective said pumping chambers, said diaphragm bodies being connected by at least one diaphragm rod in said central housing, four check valves located in respective said valve chambers, a pair of two-way valves located in the central housing, said two-way valve connecting the housing diaphragm recesses, said housing diaphragm recesses acting as drive chambers, and a main valve connected to said two-way valves for reversing fluid flow in the pump at the end of each reciprocating stroke.

* * * * *